US006578499B2

(12) United States Patent
Kroll et al.

(10) Patent No.: US 6,578,499 B2
(45) Date of Patent: Jun. 17, 2003

(54) WIND AND INSECT RESISTANT PICNIC SYSTEM

(75) Inventors: Mark W. Kroll, Simi Valley, CA (US); Lori C. Kroll, Simi Valley, CA (US); Karl J. F. Kroll, Maple Grove, MN (US)

(73) Assignee: Kroll Family Trust, Simi Valley, CA (US)

( * ) Notice: Subject to any disclaimer, the term of this patent is extended or adjusted under 35 U.S.C. 154(b) by 46 days.

(21) Appl. No.: 09/790,380

(22) Filed: Feb. 21, 2001

(65) Prior Publication Data

US 2001/0007325 A1 Jul. 12, 2001

Related U.S. Application Data

(63) Continuation-in-part of application No. 09/191,545, filed on Nov. 13, 1998, now abandoned, which is a continuation-in-part of application No. 08/878,250, filed on Jun. 18, 1997, now abandoned.

(51) Int. Cl.[7] ..... A47B 13/08
(52) U.S. Cl. ..... 108/90
(58) Field of Search ..... 108/90, 25, 26; 150/158

(56) References Cited

U.S. PATENT DOCUMENTS

| | | | | |
|---|---|---|---|---|
| 1,898,739 | A | | 2/1933 | Meutsch |
| 1,942,287 | A | | 1/1934 | Heitz |
| 2,728,165 | A | * | 12/1955 | Runyon |
| 3,080,997 | A | | 3/1963 | Brown |
| 3,430,803 | A | | 3/1969 | Nelson |
| 3,847,324 | A | | 11/1974 | Uchanski |
| 3,939,976 | A | * | 2/1976 | Vaniseghem, Jr. |
| 4,063,559 | A | | 12/1977 | Tritsch |
| 4,166,152 | A | | 8/1979 | Baker |
| 4,708,183 | A | | 11/1987 | Figueroa |
| 4,716,194 | A | | 12/1987 | Walker |
| 4,735,837 | A | | 4/1988 | Miyasaka |
| 4,746,057 | A | | 5/1988 | Wagner |
| 4,755,550 | A | | 7/1988 | Shuman |
| 5,005,704 | A | | 4/1991 | Martin |
| 5,009,310 | A | | 4/1991 | Finney |
| 5,194,299 | A | | 3/1993 | Fry |
| 5,208,084 | A | * | 5/1993 | Rutz |
| 5,235,919 | A | | 8/1993 | Robuck |
| 5,326,644 | A | | 7/1994 | Scholz |
| 5,379,703 | A | | 1/1995 | Marshall |
| 5,413,302 | A | | 5/1995 | Ferster |
| 5,609,933 | A | * | 3/1997 | Stepanek |
| 5,663,241 | A | | 9/1997 | Takamatsu |
| 5,670,226 | A | | 9/1997 | Yoshizawa |
| 5,697,302 | A | | 12/1997 | Putnam |

FOREIGN PATENT DOCUMENTS

DE 3616730 A1 * 11/1987

* cited by examiner

*Primary Examiner*—Jose V. Chen

(57) ABSTRACT

A disposable dish system, with the bottom surfaces of the disposable dishes being at least partially coated with a light tack non-toxic adhesive to retain it to a tablecloth, tray, or table in a manner which will be resistant to wind or tipping, but yet allow for easy removal and replacement during use. Also a wind-resistant disposable tablecloth which includes adhesive disposed at certain locations on the tablecloth for use in retaining the tablecloth on a picnic table or a similar table or surface. The tablecloth has the adhesive placed thereon in strips, which are covered by strips of release liner prior to the tablecloth being used. The release liner strips are removed to expose the adhesive on the tablecloth, which is used to secure the tablecloth on the picnic table.

9 Claims, 10 Drawing Sheets

WIND AND INSECT RESISTANT PICNIC SYSTEM

This application is a continuation in part of Ser. No. 09/191,545 filed Nov. 13, 1998 now abandoned which is a continuation in part of Ser. No. 08/878,250 filed Jun. 18, 1997, now abandoned (Wind Resistant Picnic Dishes.)

BACKGROUND OF THE INVENTION

Disposable plates and bowls are very convenient for picnics and outdoor eating events along with disposable tablecloths. However, the lightweight disposable dishes have the obvious outdoor problem of being blown away by the wind. This causes aggravation and litter. Another problem in some parts of the country is the attraction of mosquitoes to the scented food and people. It is generally not considered acceptable to spray mosquito repellent chemicals around food for reasons of safety and taste.

One potential solution to the problem of picnic dishes being blown away is to add an adhesive to the bottom of the dishes. This is taught in Brown (U.S. Pat. No. 3,080,997) and Uchanski (U.S. Pat. No. 3,847,324). However, both of these inventions are based on the use of conventional adhesives which would not function in a system with a disposable tablecloth.

For example, Brown teaches (column one, line 60, 1–63) the use of a "conventional pressure sensitive type" of adhesive. This is acceptable for the desired purpose which was to minimize the risk of the ashtray being overturned and causing a fire. But, such an adhesive would tear a disposable paper or plastic picnic tablecloth. Thus it would be extremely inconvenient for use in a picnic in which one might like to reposition the plate, rotate it, or pick it up and return to the table after a second helping. The Brown adhesive requires a release liner for separation from other ashtrays in the stacking as described in column 1 lines 63 to column 2 line 1 and column 2 lines 8 and 9. Such a release liner is inconvenient for use in a picnic environment as it doubles the amount of litter that is produced in addition to the fact that the adhesive does not allow for repositioning.

The Uchanski patent also teaches the use of conventional adhesives underneath dishware. In this case they are a drinking glass and a plate. Again the patent teaches the use of strong adhesives such that the glasses would not tip even if a serving tray were to be rocked. While this may prove to be a useful device (although not in commercial use) such an adhesive would be clearly too strong for picnic use since it would tend to tear the disposable table cloths. It would also be awkward to pick up and drink from. Again, such strong adhesive requires the use of release liners in order to separate the plates or cups as discussed in column 2 lines 1–4.

SUMMARY OF THE INVENTION

In spite of the need for a wind resistant picnic dish which is repositionable, there has been no such invention taught to date. There is no teaching of the use of a nontoxic adhesive to allow the direct stacking of dishes on top of one another. One aspect of this invention is a picnic dish with adhesives having low peel removal forces to allow repositioning made by a novel construction technique. A further aspect is a picnic table cloth with adhesives attached. A further aspect is a table cloth with a mild insect repellent. Another aspect is a method of packaging the above items.

DETAILED DESCRIPTION OF THE DRAWINGS

Figure 1:
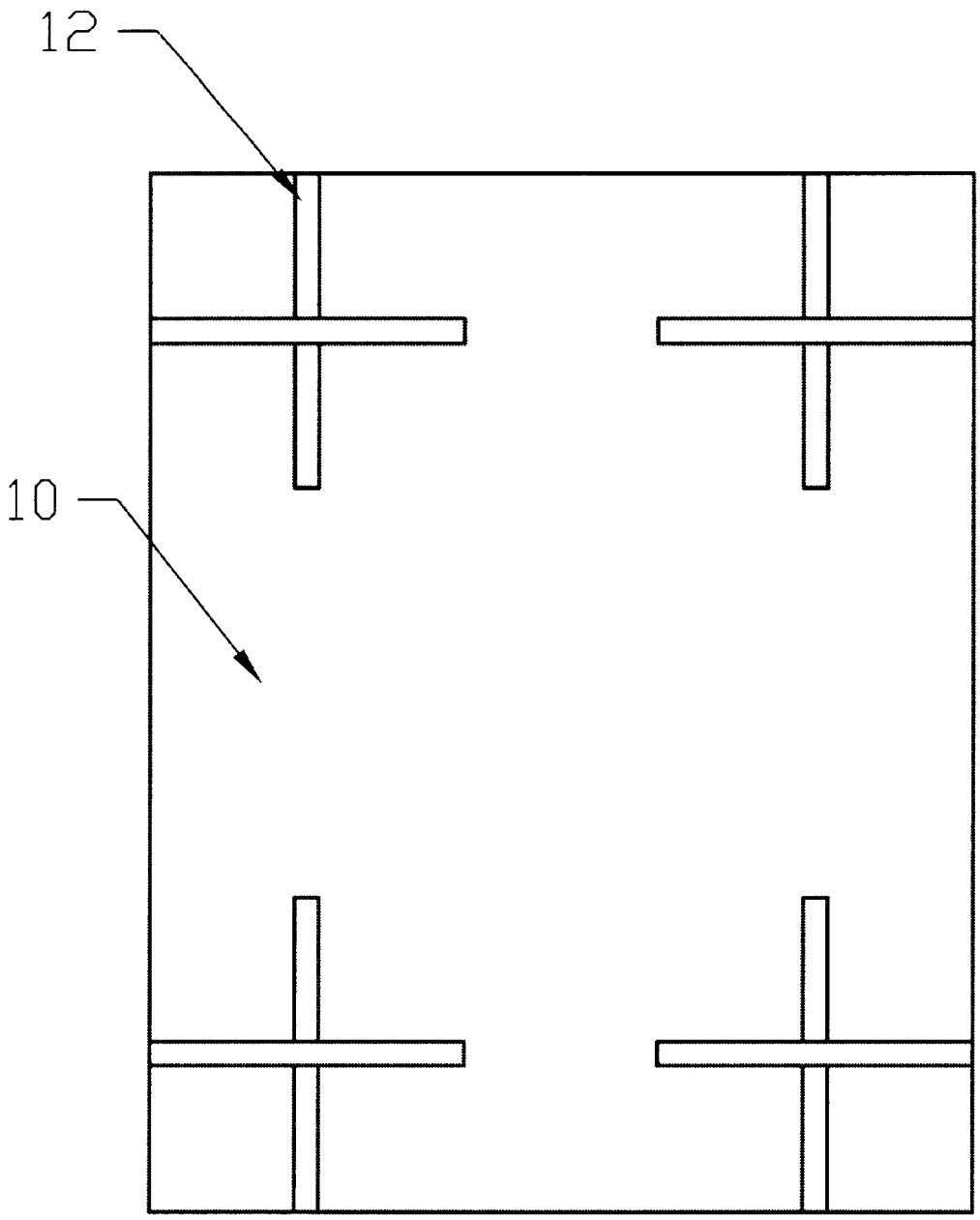
FIG. 1 shows a plan view of the tablecloth fully unfolded.

FIG. 1 shows the plan view of the fully unfolded tablecloth 10. The adhesive strips 12 consist of very conventional adhesives with the use of a release liner strip over them. The release liners may be detachable and separately disposable. Or, they may be attached on one end so that they dangle down decoratively after exposing the adhesive surface. In this embodiment they could be festively decorated. Suitable adhesives are Rhoplex trade name emulsions from Rohm and Haas or the Ucar brand adhesive from Union Carbide Corporation.

The tablecloth may be made of any lightweight inexpensive material such as paper or plastic. Other attractive hybrid materials include cross-linked paper such as that produced under the tradename of Tyvek. The paper may be treated or scented with a non-toxic mild insect repellent such as garlic oil.

It is surprisingly difficult to make a picnic plate adhere to a lightweight tablecloth and yet be removable without damaging the tablecloth. As discussed in the background section, the approaches of the prior art simply do not function in this application. The adhesive used must have a low peel adhesion that is under 100 grams per linear centimeter. Peel adhesion can be measured by the PSTC-1 standard (pressure sensitive tape council) or the Japanese standard JIS-Z-1523.

It is also difficult to make a tablecloth repositionably attachable to itself without damage. This requires a peel adhesion in the range of 30–120 g/cm.

The second issue is that even this reduced peel adhesion must be tapered or the edge of the adhesive area on the plate will tend to stretch and distort (or tear) the tablecloth at the point of lifting. Also, the peel adhesion must start at near zero level at the edge of the flat plate area and increase to its maximum level towards the middle. Representative values for appropriate peel adhesion in the center of the plate are between 50 and 100 g/cm. Representative values for the edge of the adhesive area are between zero and 30 g/cm. Such a range of peel adhesion is not available with any practical adhesive. Thus special application techniques and/or aggregating techniques must be used.

Figure 2:
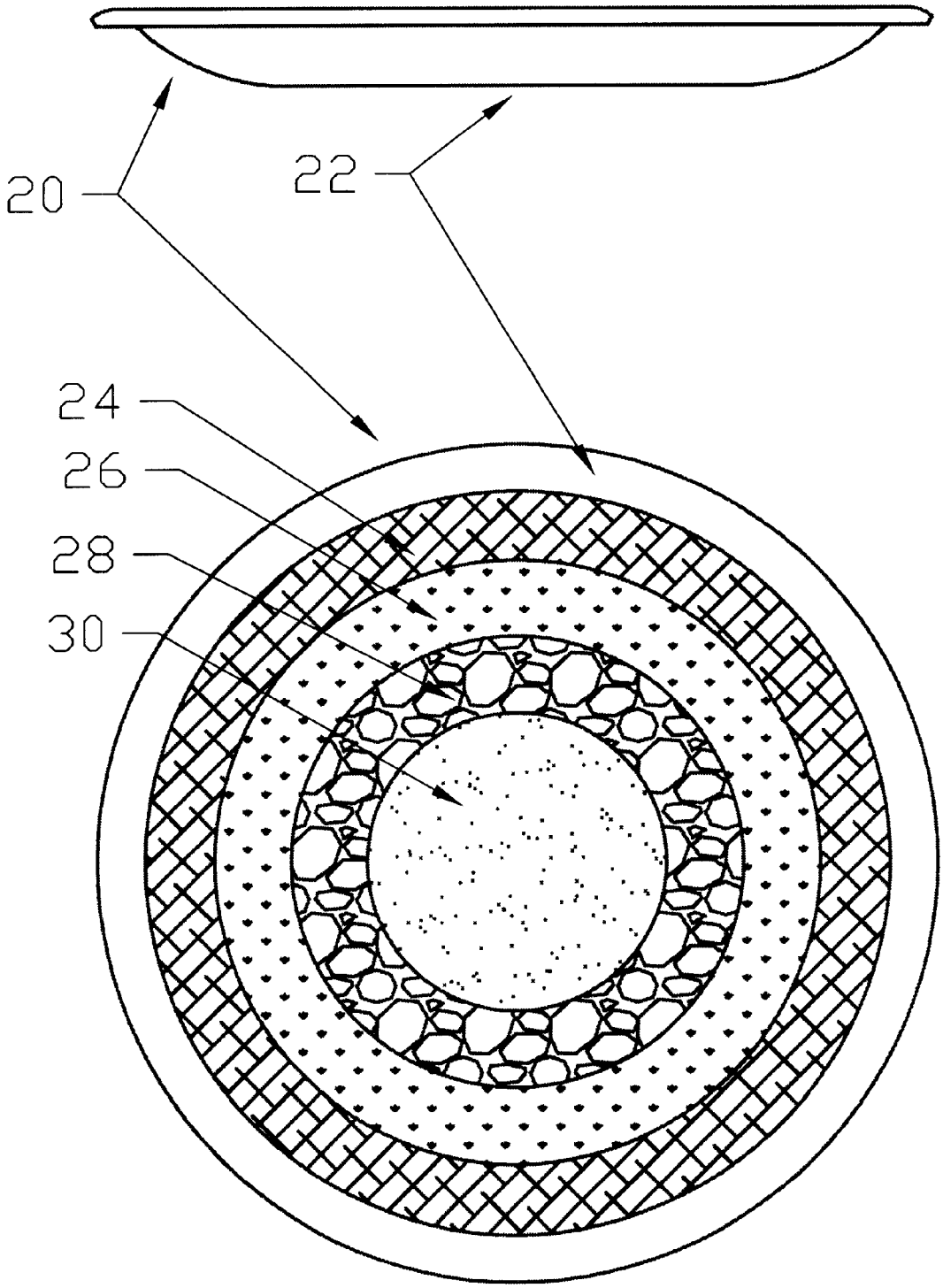
FIG. 2 shows a plan view looking at the bottom of the picnic plate and an edge view.

FIG. 2 shows a plate 20 with a smooth underside region 22 for the application of the adhesive. The outermost region of the adhesive is an annulus 24 with a typical peel adhesion range of 0–20 g/cm. The next region 26 has a slightly higher peel adhesion in the order of 10–50 g/cm. The region 28 after that has a peel adhesion in the range of 30 –80 g/cm.

The innermost region 30 will have a peel adhesion in the range of 50–100 g/cm.

Alternatively the innermost region could be left uncoated. This would result in a slightly increased tendency for the plate to be lifted off by windforces but would also result in an easier user lifting and would not degrade the ability of the plate to be peeled up as that is controlled by the adhesive on the edge.

Figure 3:
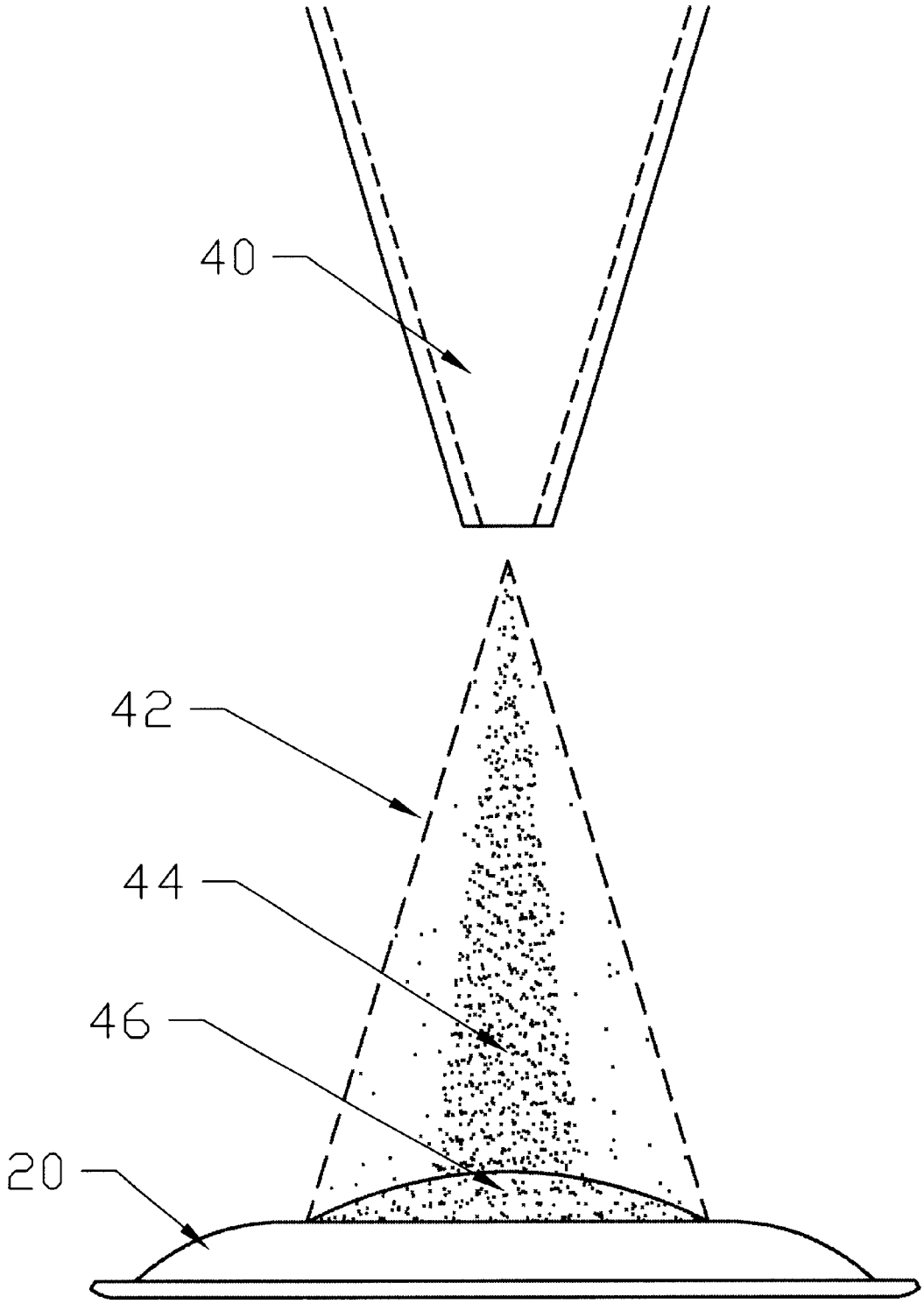
FIG. 3 shows a spray pattern to be used for coating the picnic plate bottom in one embodiment of this invention.

FIG. 2 shows a tapering with the use of 4 discreet regions of peel adhesion. This could be replaced with a continuous tapering as taught in FIG. 3. Here plate 20 is upside-down and its underside is being coated by an adhesive being sprayed from a jet 40. The outer boundary of this conical flow of spray adhesive 42 restricts the adhesive to go to the underside of the plate. However, the adhesive spray is concentrated towards the center of the cone as shown by the accented area 44. This will result in the adhesive density profile shown in 46.

Again, a conventional adhesive such a Rhoplex could be used in this application but by spraying small droplets the result is a reduced peel adhesion and lack of damage to the underlying tested plate or disposable tablecloth during removal or repositioning. The jet is adjusted to generate adhesive droplets on the order of 20–200 microns. The density and time of the spraying are limited so that the coverage of these droplets is in the range of 15–75 percent. This results in the adhesive regions being very small and having dimensions on the order of 100 microns. During the peeling operation the adhesion "jumps" from one tiny region to the other thus reducing the overall peel adhesion and eliminating the problem of tearing the lightweight disposable tablecloth.

Since the adhesive is not transferred to the eating surface of the plate below and the adhesive, such as Rhoplex, is nontoxic in low doses, there is no problem in stacking the dishes without the use of a littering and inconvenient release liner.

To gain an appreciation of the difficulty of generating an adhesive with less than 100 g/cm one needs to only review the peel adhesion of common tapes. Packing tapes have peel adhesions on the orders of 800–1000 g/cm. Even masking tape which is typically thought of as being very removable has a peel adhesion of over 200 g/cm. While masking tape is easily removable from wood or metal (and other rigid surfaces) it cannot be removed from lightweight papers or thin plastics without tearing or distorting.

Figure 4:
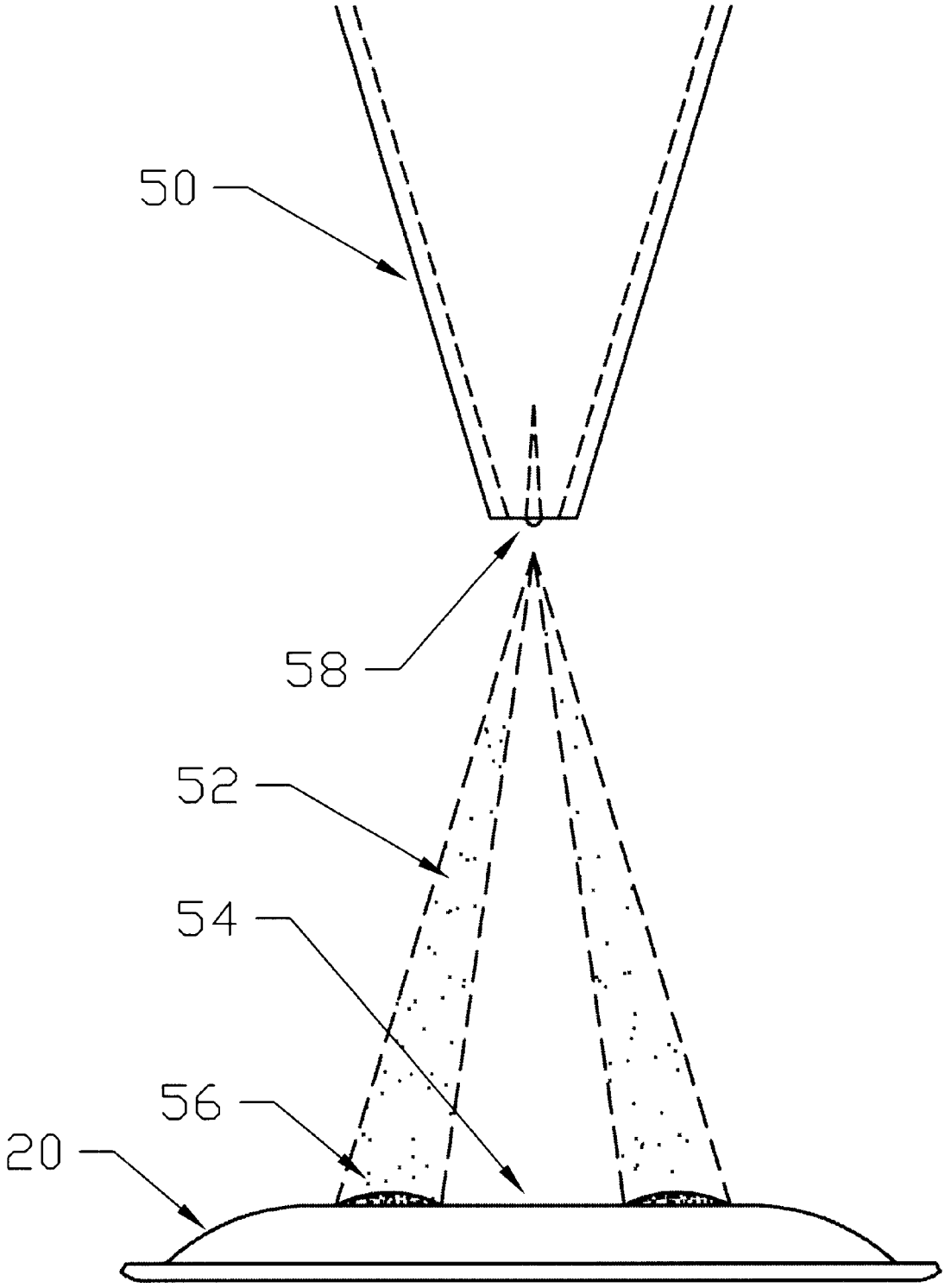
FIG. 4 shows the spray technique and pattern for coating the picnic plate bottom in accordance with an alternative embodiment of this invention.

A dual approach which yields the same results from a different strategic direction is shown in FIG. 4. There the spray nozzle 50 is used to coat the bottom surface of the plate 54 with a profile 56. However, the spray nozzle has a center barrier 58 which results in the spray having a pattern 52 which is minimal in the center of the cone and maximum on the outside. What is being sprayed in this case is material to finely adjust the peel adhesion of an adhesive which was previously bonded and as yet uncured.

For example, the spray could be of elastic polymer balls with average diameters in the range of 1–100 microns. These balls result in the adhesive standing off from the surface that they adhere to, thus reducing the tack. The balls also break up the adhesive into small regions or into non-convex regions thus allowing the easier peeling without damage.

The microparticles may be either solid polymers or can be made hollow by performing a suspension polymerization step beginning with a water and oil emulsion. The solid balls are less expensive but the hollow balls can be made more elastic and thus give a greater ability to follow the surface of the tablecloth.

The use of the polymer balls also maintains the non-toxicity of the existing adhesive.

This invention is not limited to the recreational picnicking application. Many other situations can call for movement restricted dishes. For example, institutional food service of food on trays could benefit. This could be applied to handicapped food service, or other situations such as airline food in which tipping or turbulence can be a problem.

This invention is also not limited to disposable dishes. For example, a washable non-toxic adhesive could be used for institutional applications. The adhesive would be added by briefly setting the plate in an adhesive pan and then adding the food. After use, the adhesive would be washed off by the conventional dishwashing procedure.

Figure 5:
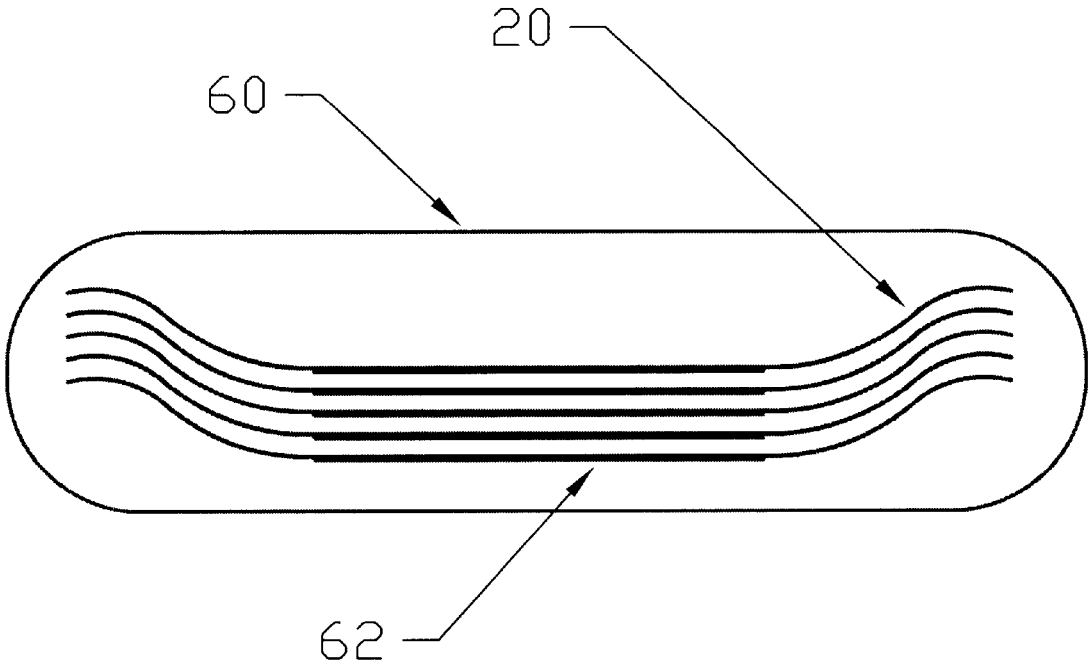
FIG. 5 teaches the packaging method of this invention for the dishes.

FIG. 5 shows the plates of this invention as packaged for sale. The outer airtight wrapper 60 contains a number of plates 20 each with its underside adhesive 62.

Due to the low peel adhesion of the plates and the non-toxic adhesives used the plates can be stacked on top of each other without the need for the extra expense and litter problems of a release liner.

This can be utilized in a method of packaging wind resistant dishes comprising the steps of selecting a light non-toxic adhesive, adding adhesive to a predetermined portion of the bottom of a set of dishes, stacking one dish on top of one another, and securing the stack into a container, thus allowing the dishes to be used in windy outdoor situations without the need for release liners or special shapes to keep the adhesive on one dish from contacting the surface of the dish below.

One embodiment of the method involves the use of a light non-toxic adhesive with a peel adhesion of 30–100 g/cm. Another embodiment of the method involves the use of adhesive to which is added a tapered level of adhesion across the surface of the adhesive. With this method the adhesive could be attached with a spray technique or with microscopic balls embedded in the adhesive to control the agent.

Figure 6:
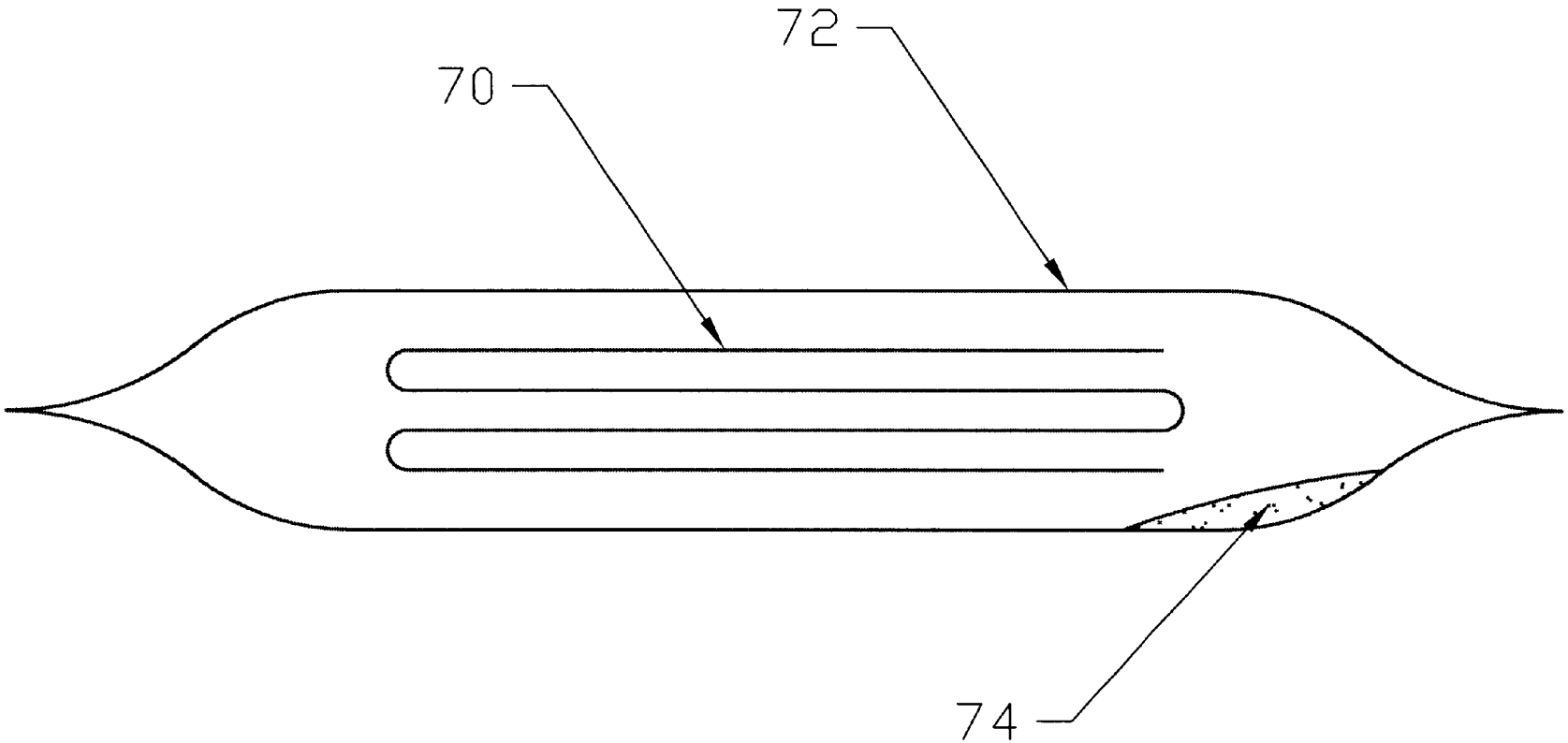
FIG. 6 teaches the packaging method for the tablecloth of this invention.

FIG. 6 shows the packaging of the tablecloth of this invention as would be presented for sale. The folded tablecloth 70 is completely enclosed within a sealed polymer or foil or paper pouch 72. A small amount of non-toxic non-offending insect repellent 74 may be included in the pouch.

Figure 7:
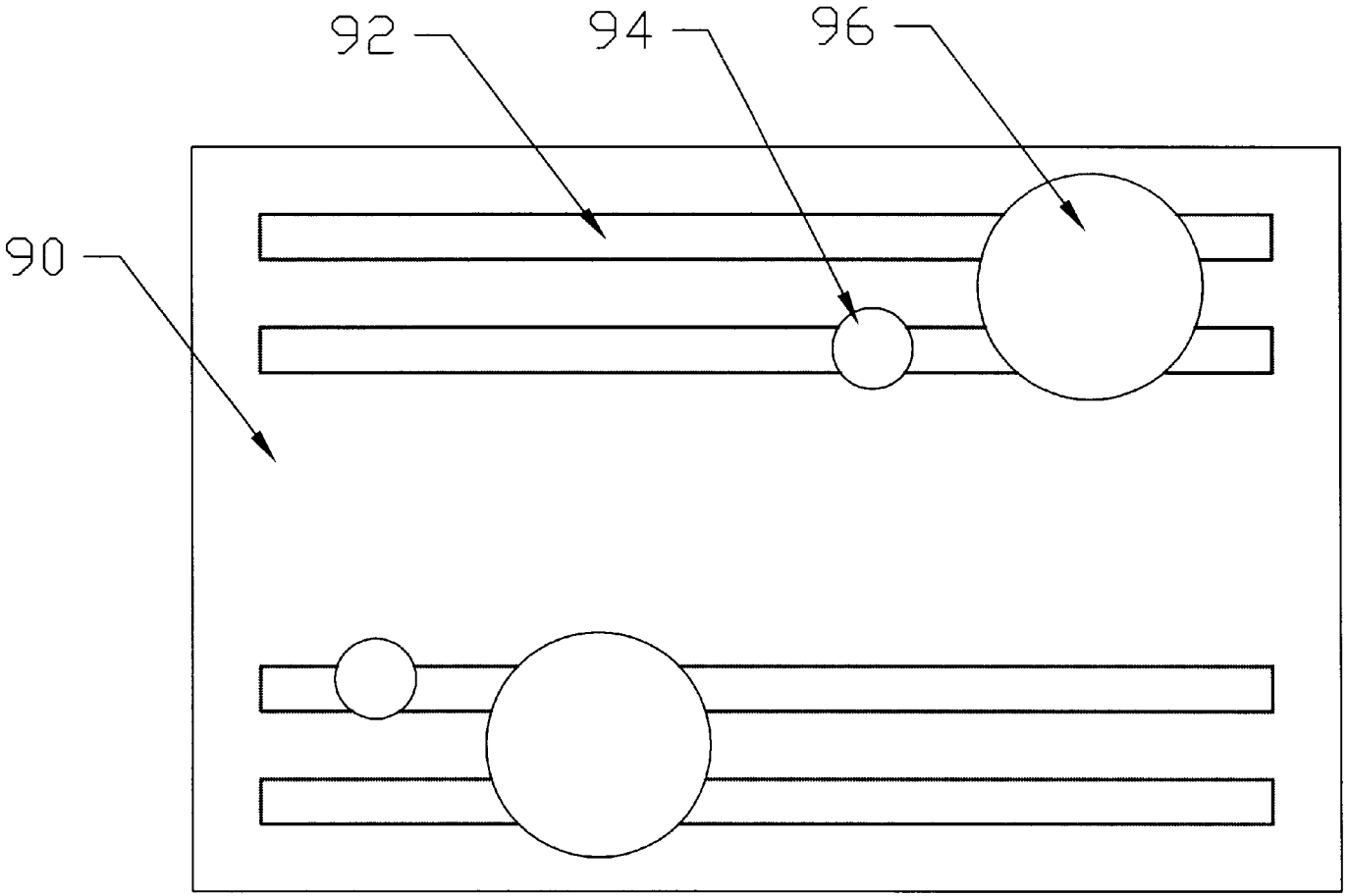
FIG. 7 teaches a tablecloth which uses adhesive strips on top in order to hold the plates.

FIG. 7 shows an embodiment of a tablecloth 90 in which strips of adhesive 92 are on the top (eating surface) and are able to restrain cup 94 and plate 96. The tablecloth preferably will also have the adhesive on the bottom as discussed before.

Figure 8:
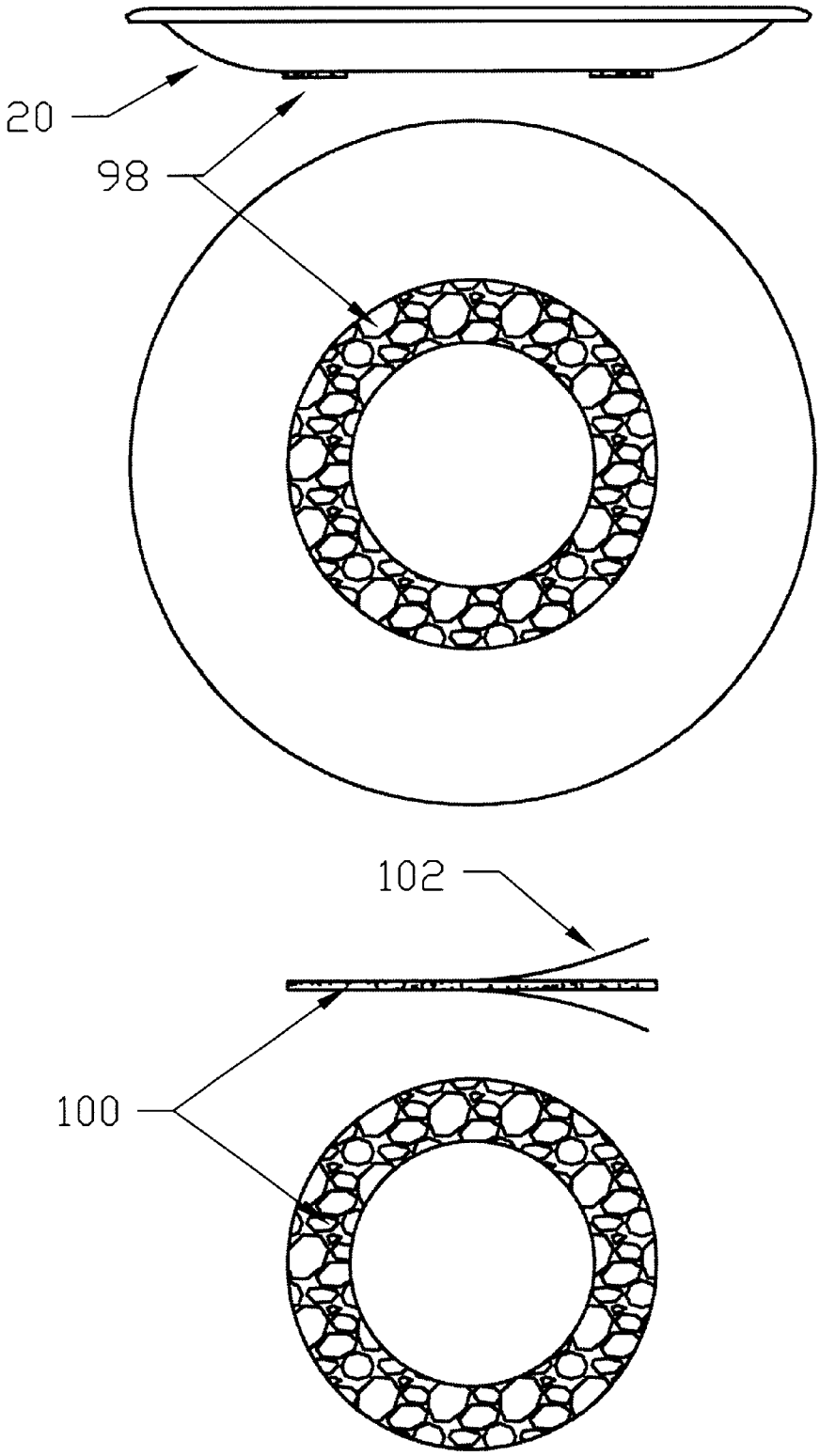
FIG. 8 teaches a plate with a single ring of adhesive.

FIG. 8 shows an embodiment of the invention in which the adhesive ring 100 is packaged and sold unattached to the plate. In this way the adhesive is only used for windy days. Release liners 102 are removed from both sides and attached to plate 20 so that the adhesive ring is positioned on the plate at location 98.

Figure 9:
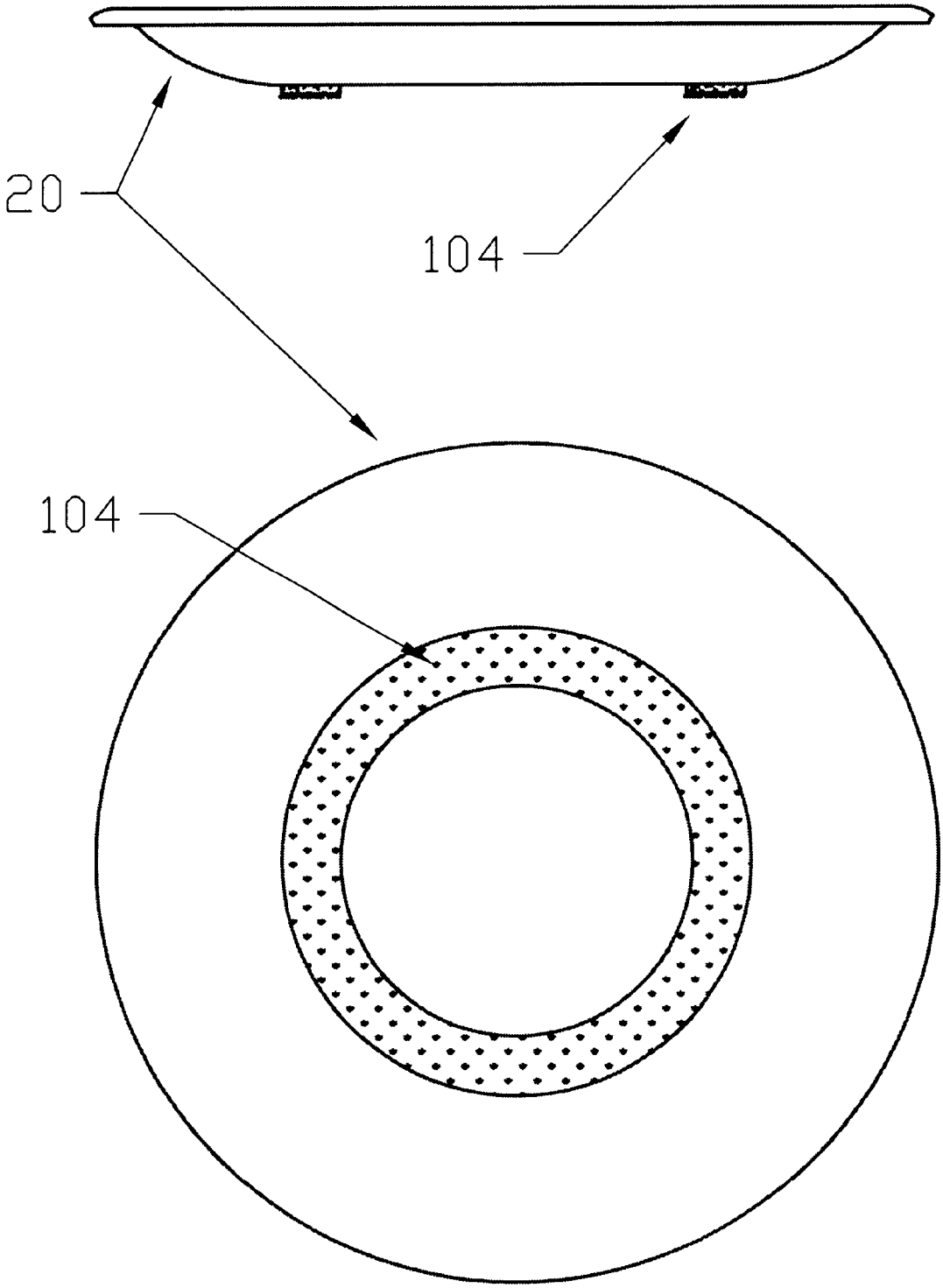
FIG. 9 teaches a plate with hook and loop fasteners.

FIG. 9 shows an embodiment of the invention in which a hook and loop ring 104 is attached to the plate 20. This would cooperate with a picnic table with soft cloth or with the mating hooks or rings.

Figure 10:
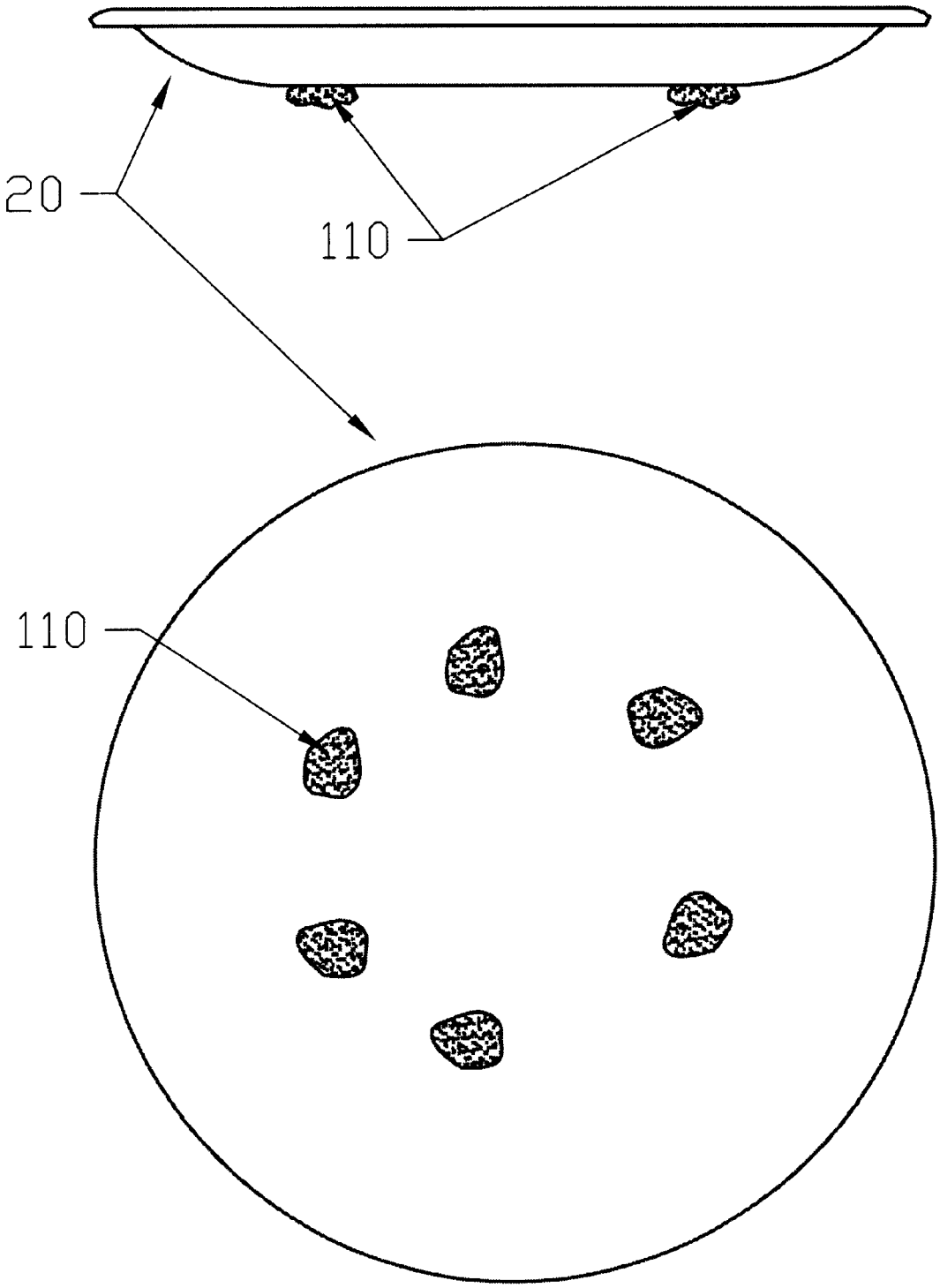
FIG. 10 teaches a plate with putty lumps.

FIG. 10 shows an embodiment of the invention in which tacky putty deposits 110 is attached to the plate 20. A suitable tacky putty would be the type used to attach posters to walls.

We claim:

1. A method of packaging wind resistant dishes comprising of steps of: Selecting a light non-toxic adhesive, adding adhesive to a pre-determined portion of the bottom of a set of dishes, stacking one dish on top of one another, and securing the stack into a container, thus allowing the dishes to be used in windy outdoor situations without the need for release liners or special shapes to keep the adhesive on one dish from contacting the surface of the dish below.

2. The method of claim 1 in which the light non-toxic adhesive has a peel adhesion of 30–100 g/cm.

3. The method of claim 1 in which the adhesive is added with a tapered level of adhesion across the surface of the adhesive.

4. The method of claim 1 in which the adhesive is attached with a spray technique.

5. The method of claim 1 in which microscopic balls are embedded in the adhesive to control the adhesion.

6. The method of claim 1 in which the adhesive is in the form of a separate adhesive ring to be attached by the consumer.

7. The method of claim 1 in which the adhesive is of the hook and loop variety.

8. The method of claim 1 in which the adhesive is putty.

9. A lightweight disposable tablecloth comprising:

a sheet of thin, lightweight material, said sheet being of a size suitable for use as a tablecloth and having a first side and a second side and a plurality of corners;

a plurality of strips of adhesive material applied to said first side of said sheet at a plurality of locations at least some of which are located near said corners of said sheet; and a plurality of release liner strips located over said plurality of strips of adhesive material, each of said release liner strips being removable from the particular one of said strips of adhesive material covered by the particular one of said release liner strips to expose said particular one of said strips of adhesive material, said strips of adhesive material being useable to retain said sheet on a surface to which it is applied; and a plurality of strips of adhesive material applied to said second side of said sheet at a plurality of locations in order to restrain the movement of articles placed on the second side.

* * * * *